United States Patent [19]

Yamamoto et al.

[11] Patent Number: 4,783,613

[45] Date of Patent: Nov. 8, 1988

[54] IMPREGNATED CATHODE

[75] Inventors: Shigehiko Yamamoto, Tokorozawa; Isato Watanabe, Hachioji; Sadanori Taguchi, Tokyo; Susumu Sasaki, Kokubunji, all of Japan

[73] Assignee: Hitachi, Ltd., Tokyo, Japan

[21] Appl. No.: 55,035

[22] Filed: May 28, 1987

[30] Foreign Application Priority Data

May 28, 1986 [JP] Japan ..... 61-121005
Oct. 3, 1986 [JP] Japan ..... 61-234569

[51] Int. Cl.[4] ..... H01J 19/02; H01J 19/06

[52] U.S. Cl. ..... 313/346 R; 313/630; 313/632; 252/515; 252/521

[58] Field of Search ..... 313/346 R, 346 DC, 630, 313/632, 633; 252/515, 521

[56] References Cited

U.S. PATENT DOCUMENTS 4,518,890 5/1985 Taguchi et al. ..... 313/346 R
4,594,220 6/1986 Hasker et al. ..... 313/346 R
4,625,142 11/1986 Van Esdonk et al. ..... 313/346 DC

FOREIGN PATENT DOCUMENTS 3000169 8/1982 Fed. Rep. of Germany ... 313/346 R

*Primary Examiner*—David K. Moore
*Assistant Examiner*—Michael Horabik
*Attorney, Agent, or Firm*—Antonelli, Terry & Wands

[57] ABSTRACT

An impregnated cathode comprising a refractory porous body whose pore parts are impregnated with an electron emissive material including barium and a thin film layer comprising tungsten, scandium and/or an oxide of scandium, deposited on the surface of the refractory porous body, characterized in that the thin film layer contains an oxide of tungsten, and/or an oxide of tungsten and scandium, has a distinguished electron emission property and a long life.

15 Claims, 2 Drawing Sheets

IMPREGNATED CATHODE

BACKGROUND OF THE INVENTION

This invention relates to an impregnated cathode for use in an electron tube such as a display tube, a picture tube, a pick-up tube, a traveling wave tube (TWT), etc. as a high current density cathode, and particularly to an impregnated cathode with higher electron emission.

The impregnated cathode is a high current density cathode and is promising as a cathode for higher quality, particularly higher resolution and higher brightness of en electron tube.

The conventional impregnated cathode has such a basic structure that a refractory porous body composed of W, etc. is impregnated with an electron emissive material composed of a barium (Ba) compound, and has a high electron emission property, but its operating temperature necessary for obtaining the necessary current density of 10 A/cm$^2$ for the higher quality is as high as 1,100°–1,200° C., which is by about 400° C. higher than that of the spray type oxide cathode now generally used. Owing to the high operating temperature, the electrode material must be a high melting point metal when it is practically used in an electron tube, and furthermore, a large amount of Ba and BaO (barium oxide) evaporates from the cathode and deposits onto the electrode, causing a grid emission and bringing an adverse effect on the electron tube characteristics. Furthermore, it is very difficult to design and produce a reliable heater capable of heating the impregnated cathode for a long duration. Thus, it is the most important task in the research and development of an impregnated cathode to lower the operating temperature of the impregnated cathode. In order to lower the operating temperature, the electron emission must be increased, and as a result the operating temperature will be lowered. According to a procedure for lowering the operating temperature, that is, a procedure for increasing the electron emission, as disclosed in Japanese Patent Publication No. 47-21343, the work function of the cathode is lowered by coating the cathode surface with a metal having a high work function such as an osmium (Os) -ruthenium (Ru) alloy, etc., thereby enhancing the electron emission, where the operating temperature of the impregnated cathode can be lowered by about 100°–150° C., which is still by 250° C. higher than the operating temperature of the spray-type oxide cathode. Some of the present inventors thus proposed an impregnated cathode provided with a thin film composed of a high melting point metal and at least one of Sc and an oxide of Sc on the electron emissive surface of a refractory porous body [Japanese Patent Application Kokai (Laid-open) No. 51-13526]. The operating temperature of the cathode could be made lower by 100°–150° C. than that of the impregnated cathode coated with the said Os-Ru alloy, but the cathode had a little shorter life.

SUMMARY OF THE INVENTION

An object of the present invention is to provide a highly reliable impregnated cathode having a higher electron emission at a low operating temperature and a longer life.

This and other objects of the present invention can be attained by an impregnated cathode which comprises a refractory porous body base metal, whose pore parts are impregnated with an electron emissive material including barium, and a thin film layer comprising tungsten and at least one member selected from the group consisting of scandium and an oxide of scandium on the surface of the base metal, characterized in that the thin film layer contains at least one oxide selected from the group consisting of an oxide of tungsten and an oxide of tungsten and scandium.

DETAILED DESCRIPTION OF PREFERRED EMBODIMENTS

The base metal of the present impregnated cathode is a so far known ordinary cathode, that is, a refractory porous body made of W, Mo, Ir, Pt, Re or alloy powder containing these metal elements, whose pore parts are impregnated with an electron emissive material including Ba. The electron emissive material is generally based on a $Ba_3Al_2O_6$ compound and further contains such oxides as CaO, SrO, MgO, $ZrO_2$, $Sc_2O_3$, $Y_2O_3$, etc. to improve the electron emission property and the control of Ba evaporation. A thin film layer to be coated onto the cathode surface can be formed by sputtering evaporation, chemical vapor deposition (CVD), etc.

Figure 1:
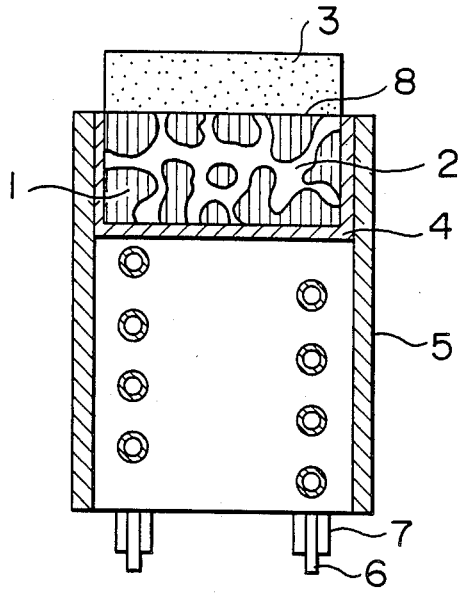
FIG. 1 is a schematical cross-sectional view of an impregnated cathode according to one embodiment of the present invention.

FIG. 1 is a schematic cross-sectional view of an impregnated cathode according to one embodiment of the present invention, where numeral 1 is a refractory porous body, 2 pores impregnated with an electron emissive material, 3 a thin film layer, 4 a barrier layer, 5 a sleeve, 6 a heater and 7 an alumina coating.

At first, the cathode surface was coated with a thin $Sc_2O_3$ layer by sputtering evaporation, and the electron emission property thereof was measured. It was found that it had a higher electron emission property than that of the underlayer cathode. Then, oxides containing W and Sc, that is, $Sc_2W_3O_{12}$ and $Sc_6WO_{12}$, were synthesized and coated onto the cathode surface. It was found that they had a higher electron emission property than that of the thin $Sc_2O_3$ film coated on the cathode surface, and further that $Sc_2W_3O_{12}$ had a higher electron emission property than that of $Sc_6WO_{12}$. Furthermore, sputter targets of various compositions were prepared from $Sc_2O_3$ powder and W powder, and coated onto the cathode surface. As a result of measuring their electron emission properties, it was found that the equivalent electron emission properties could be obtained at a lower operating temperature by about 250° C. Thus, it was found that it was an effective means or increasing the electron emission property of a cathode to provide a thin film layer composed of W and an oxide containing Sc and W on the cathode surface. Furthermore, it was found that coating with a multi-component target of W and $Sc_2W_3O_{12}$ in a layer also had the similar effect. Further studies revealed that the composition of a thin layer film having higher electron emission properties than that of the impregnated cathode coated with a metal such as Os-Ru alloy, etc. was 2 to 50% by weight of $Sc_2W_2O_6$ or $Sc_2W_{312}$, most of the balance being W, and a remarkable effect was obtained in a film thickness range of 10 nm to 10 μm, preferably 50 to 1,000 nm, where such a metal as Mo, Re, Pt, Ir, Ta, etc. or their alloys may be contained in an amount of less than 50% by weight of W, and this will be also applicable to the examples which follow.

It was also found that an impregnated cathode coated with a thin film layer composed of W, tungsten oxides such as $WO_2$, and $Sc_2O_3$ had substantially the same effect.

At first, a cathode surface was coated with a thin $Sc_2O_3$ film layer by sputtering evaporation and its electron emission property was measured, and found to be increased. Then, another cathode surface was coated with a W and $Sc_2O_3$ layer, and its electron emission property was measured, and found to be considerably increased, that is, the equivalent electron emission property could be obtained at a lower operating temperature by about 200° C. Furthermore, it was found that the electron emission property could be much more increased by adding $WO_2$ to the W and $Sc_2O_3$ layer. That is, the equivalent electron emission property could be obtained at a much lower operating temperature by about 50° to 100° C., and the thin film layer composed of W, $WO_2$ and $Sc_2O_3$ was found to be effective for improving the electron emission property. A further detailed test revealed that the composition having such a high electron emission property was 2 to 30% by weight of $Sc_2O_3$ and not more than 50% by weight of $Sc_2O_3+WO_2$, the balance being W, and the remarkable effect was obtained in a film thickness range of 10 nm to 10 μm, preferably 50 to 1,000 nm.

The present thin film layer is composed of W, $WO_2$ and $Sc_2O_3$, where no influence has been found on its characteristics even by replacing a portion of W with $W_3O$.

The present thin film layer can be prepared also by oxidizing W in the thin film layer composed of Sc and/or $Sc_2O_3$ land W, for example, by introducing an oxidizing gas or vapor such as a well controlled oxygen gas, water vapor, etc. during the deposition of a thin film when the said conventional cathode is prepared. The amount of Sc and/or $Sc_2O_3$ is preferably 1 to 30% by weight, and it is preferable to oxidize 1 to 50% by weight of total W amount, where the oxide may be in the form of oxides only of W such as $WO_2$, $WO_3$, etc., or in the form of oxides of W and Sc such as $Sc_2W_3O_{12}$. The preferable thickness of the thin film layer is as described above.

In the present impregnated cathode of the said structure, the refractory porous body reacts with the electron emissive material in the impregnated cathode underlayer by heating the cathode by the heater to form Ba, and Ba reaches the cathode surface through the pores, whereas Sc and O (oxygen) are supplied to the cathode surface from the thin film layer, and Ba combines with Sc and O on the cathode surface to form a very thin (Ba, Sc, O) complex compound layer in the mono-layer order. By formation of the (Ba, Sc, O) complex compound in the mono-layer order on W, the work function is lowered from about 2.0 e.V to about 1.2 e.V. Thus, it seems that a surface of low work function is formed by providing a thin film layer on the surface of the conventional impregnated cathode, and a decrease in the work function contributes to an improvement of the electron emission property and further to a decrease in the operating temperature. Formation of the very thin (Ba, Sc, O) complex compound layer in the mono-layer order has been identified by Auger electron spectroscopy.

While the cathode is working, supply and evaporation of these elements are balanced and brought into a steady state, where O is supplemented by decomposition of oxides of W or oxides of W and Sc in the thin film.

The present invention will be described in detail below, referring to Examples and the accompanying drawings.

EXAMPLE 1

In FIG. 1, the present impregnated cathode is schematically shown in cross-section, where numeral 8 is a pellet, 1.4 mm in diameter, of cathode material, composed of a porous W body 1 having a porosity of 20 to 25% and pores 2. The pores 2 are impregnated with a mixture of $BaCO_3$, $CaCO_3$ and $Al_2O_3$ in a molar ratio of 4:1:1 as electron emissive materials. Electron emissive materials in different molar ratios or containing different kinds of materials may be used. The pellet 8 is placed in a Ta cap 4, which is then laser welded to a Ta sleeve 5. A soldering material may be used in place of the laser welding. A heater comprising a W core wire 6 coated with alumina 7 is used for heating the cathode. The foregoing is a Ba supply source. The rate of Ba to be supplied depends on a heating temperature, but can be adjusted by changing the molar ratio of the electron emissive material or adding such an activator as Zr, Hf, Ti, Cr, Mn, Si, Al, etc. to the base metal material. As a $Sc_2O_3$ supply source, a thin film 3 having a thickness of 10 nm to 10 μm, composed of W and $Sc_2O_3$, is deposited onto the pellet 8 by vacuum sputtering.

Before the vacuum sputtering, the oxygen partial pressure in a sputtering chamber is adjusted to $1\times10^{-5}$ to $1\times10^{-4}$ Torr by introducing an oxygen gas of high purity (99.9%) thereto through a gas regulator, while measuring the oxygen partial pressure by a small mass spectrometer provided at the sputtering vessel.

By this operation, W in the thin film 3 can be oxidized. It is also possible to oxidize only a portion of the thin film 3 by introducing an oxygen gas under the premeasured partial pressure in the course of sputtering. Other oxidizing gases than the oxygen gas can be introduced in place of the oxygen gas. The degree of W oxidization can be determined by measuring the electrical resistivity of a thin film sample deposited on a glass plate in advance or by X-ray photo-electron spectroscopy.

Figure 2:
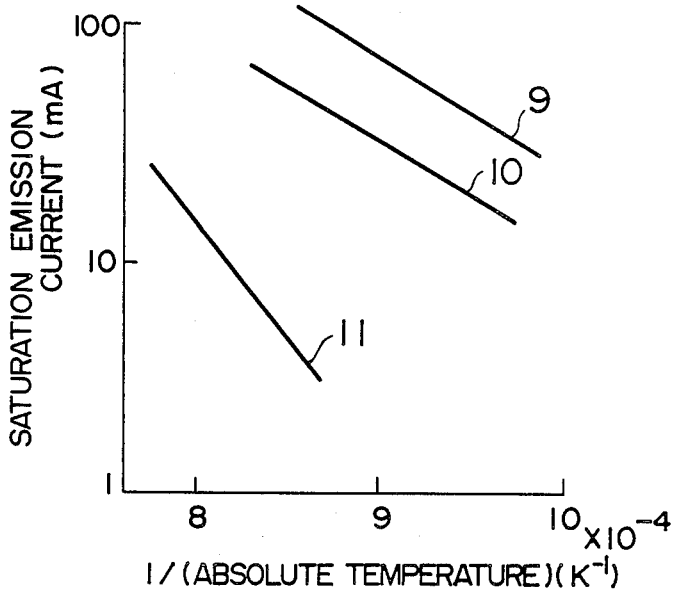
FIGS. 2 to 4 are diagrams showing the characteristics of the present impregnated cathode.

With this cathode, a saturation current density is measured by applying high pulse repetitions of 100 Hz with a width of 5 μS to the anode according to a cathode-anode diode configuration. The results as shown in FIG. 2 are obtained, where line 9 shows the characteristics of the cathode coated with a thin film composed of W and $Sc_2O_3$ according to the present invention, line 10 shows characteristics of the cathode coated with a thin film without oxidation treatment, and line 11 shows the characteristics of the cathode without the thin film. The present cathode has a life of more than 20,000 hours at 900° C.

EXAMPLE 2

An impregnated cathode underlayer is prepared from a porous W body 1 having a porosity of 23%, prepared by press molding W powder having particle sizes of 5 μm, and subjecting the molding to presintering in hydrogen and then to sintering in vacuum. Then, an electron emissive material having a composition of $4BaO.CaO.Al_2O_3$ is melted by heating in a hydrogen atmosphere, and the porous W body is impregnated with the molten electron emissive material to prepare the impregnated cathode underlayer.

A thin film layer 3 for the impregnated cathode according to the present invention is formed in an R.F. sputtering chamber. The composition of the thin film layer 3 is determined by inductively coupled plasma spectroscopy (ICPS method) and by fluorescence X-ray analysis (FLX method), and W and oxides containing W and Sc ($Sc_2W_3O_{12}$ and $Sc_6WO_{12}$) are confirmed by X-ray diffraction. Sputtering targets are prepared by mixing W powder and $Sc_2W_3O_{12}$ or $Sc_6WO_{12}$ powder synthesized in advance in various mixing ratios and press molding the resulting mixtures. Then, the impregnated cathode underlayer and the target composed of W and $Sc_2W_3O_{12}$ or $Sc_6WO_{12}$ are placed in the sputtering chamber, and, after the chamber has been evacuated to the order of $10^{-7}$ Torr, the thin film layer 3 composed of W and $Sc_2W_3O_{12}$ or $Sc_6WO_{12}$ is formed on the surface of the impregnated cathode underlayer in an Ar gas atmosphere in the order of $10^{-2}$ Torr by introducing an Ar gas into the chamber. The thin film layer 3 is formed from the targets of various compositions, and the thickness of the thin film layer 3 is changed by adjusting the sputtering time.

Figure 3:
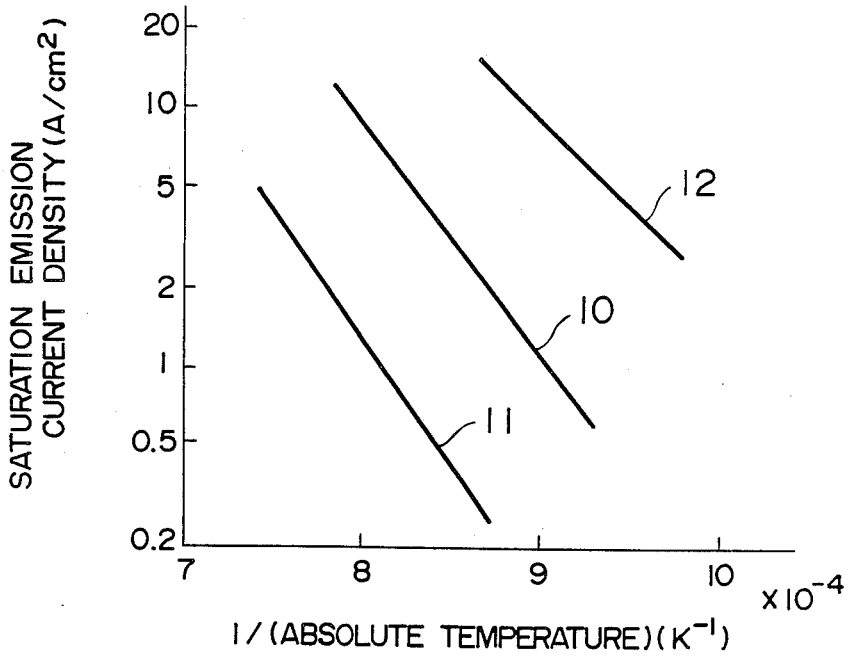

The electron emission property of the present impregnated cathode 8 provided with the thin film layer 3 thus formed is determined by applying a positive pulse voltage to the anode according to a cathode-anode diode configuration in a vacuum chamber in the order of $10^{-9}$ Torr. Typical results are shown in FIG. 3, where line 11 shows the electron emission characteristics of the conventional impregnated cathode underlayer, line 10 those of the metal film-coated, impregnated cathode, as coated with Os-Ru alloy to a layer thickness of 500 nm, and line 12 those of the present impregnated cathode provided with the thin film layer 3. The composition and the thickness of the thin layer film 3 shown in FIG. 3 are 93 wt.% W—7 wt.% $Sc_2W_3O_{12}$, as calculated from the analytical results and 210 nm, respectively.

Decrease in the operating temperature is determined from the characteristics 12 of the impregnated cathode 8 obtained according to the present invention. The present impregnated cathode can be operated at a lower temperature at least by 250° C. than that of the conventional impregnated cathode underlayer (characteristics 11) and at least by 100° C. than that of the conventional Os-Ru-coated, impregnated cathode (characteristics 10). Furthermore, the amount of evaporated barium and barium oxide is measured by mass spectrometry, and has been found to decrease proportionately to lowered operating temperature. Specifically, it has been found to decrease by the order of 1–1.5, as compared with that of the conventional impregnated cathode underlayer. By lowering the operating temperature at least by 100°–250° C., the power consumption decreases without changing the electrode material of a bulb, and furthermore the heater can have a life of a few ten thousand hours, which is substantially equivalent to that of the spray-type oxide cathode as heated. Thus, a highly reliable impregnated cathode can be obtained in the present invention.

EXAMPLE 3

A conventional impregnated cathode underlayer is prepared from a porous W body 1 having a porosity of 23%, prepared by press molding W powder having particle sizes of 5 μm, subjecting the molding to presintering in hydrogen and then to sintering in vacuum, and impregnating the sintered molding with a molten electron emissive material having a composition of 4BaO $Al_2O_3$.CaO in a hydrogen atmosphere. The present thin film layer of the impregnated cathode is formed in a sputtering chamber, and its composition is determined by inductive coupled plasma spectroscopy (ICPS method) and by fluorescence X-ray analysis (FLX method). Sputtering targets are prepared by mixing W, $WO_2$ and $Sc_2O_3$ powder in various mixing ratios and press molding the resulting mixtures. Then, the impregnated cathode underlayer and the target composed of W, $WO_2$ and $Sc_2O_3$ are placed in the sputtering chamber, and, after the chamber has been evacuated to the order of $10^{-7}$ Torr, the thin layer 3 composed of W, $WO_2$ and $Sc_2O_3$ is formed on the surface of the impregnated cathode underlayer in an Ar gas atmosphere in the order of $10^{-2}$ Torr by introducing an Ar gas into the chamber. The thin film layer 3 is formed from the targets of various compositions, and the thickness of the thin film layer 3 is changed by adjusting the sputtering time.

Figure 4:
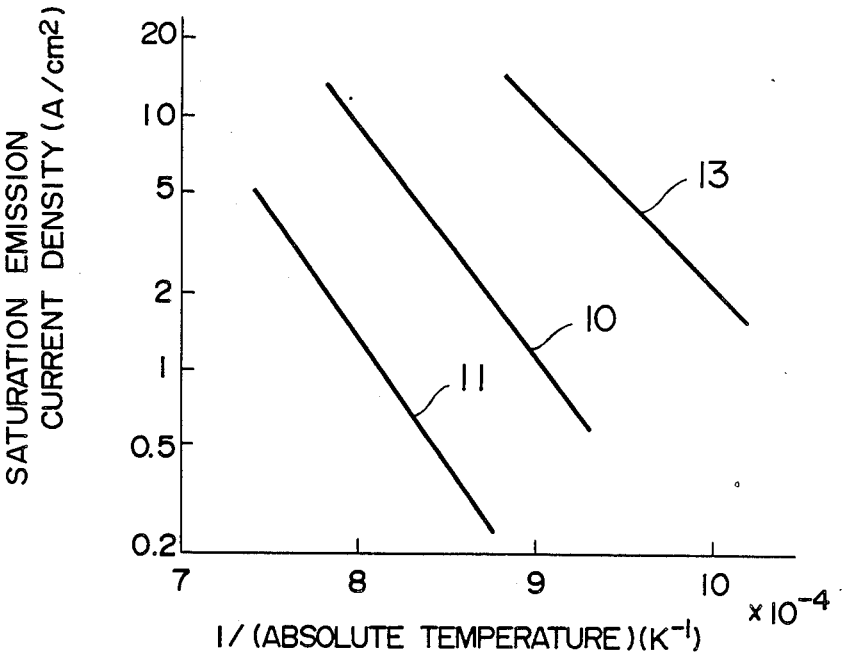

The electron emission property of the present impregnated cathode 8 provided with the thin film layer 3 thus formed is determined by applying a pulse voltage to the anode according to a cathode-anode diode parallel plate configuration in a vacuum chamber in the order of $10^{-9}$ Torr. Results are shown in FIG. 4, where line 11 shows the electron emission characteristics of the conventional impregnated cathode underlayer, line 10 those of the metal-coated, impregnated cathode, as coated with Os-Ru alloy to a layer thickness of 500 nm, and line 13 those of the present impregnated cathode coated with the thin film layer. The composition of the thin film layer shown in FIG. 4 is 78 wt.% W—17 wt.% $WO_2$—5 wt.% $Sc_2O_3$.

The present impregnated cathode shown by line 13 can be operated at a lower temperature by about 300° C. than that of the conventional impregnated cathode underlayer shown by line 10 and by about 150° C. than that of the conventional Os-Ru-coated, impregnated cathode shown by line 10. Furthermore, the amount of evaporated barium and barium oxide is measured by mass spectroscopy, and has been found to decrease by the order of 1.5–3, as compared with that of the conventional impregnated cathode under layer. By lowering the operating temperature by 150°–300° C., the power consumption decreases and furthermore the heater can have a life of a few ten thousand hours, which is substantially equivalent to that of the spray-type oxide cathode as heated. Thus, a highly reliable impregnated cathode can be obtained in the present invention.

What is claimed is:

1. An impregnated cathode which comprises a refractory porous body whose pore parts are impregnated with an electron emissive material including barium, and a thin film layer comprising tungsten and at least one member selected from the group consisting of scandium and an oxide of scandium, deposited on the surface of the refractory porous chathode, the thin film layer further containing at least one oxide selected from the group consisting of an oxide of tungsten and an oxide containing tungsten and scandium.

2. An impregnated cathode according to claim 1, wherein the at least one oxide is an oxide of tungsten obtained by oxidizing the tungsten in the thin film layer comprising tungsten and at least one member selected from the group consisting of scandium and an oxide of scandium.

3. An impregnated cathode according to claim 2, wherein the thin film layer has a thickness of 10 nm to 10 μm.

4. An impregnated cathode according to claim 1, wherein the thin film layer contains an oxide containing tungsten and scandium.

5. An impregnated cathod according to claim 4, wherein the oxide containing tungsten and scandium is at least one of $Sc_2W_3O_{12}$ and $Sc_6WO_{12}$.

6. An impregnated cathode according to claim 4, wherein the thin film layer has a thickness of 10 nm to 10 μm.

7. An impregnated cathode according to claim 4, wherein the oxide containing tungsten and scandium is in an amount of 2% to 50% on the basis of the weight of the thin film layer.

8. An impregnated cathode according to claim 1, ( wherein the thin film layer contains tungsten oxide.

9. An impregnated cathode according to claim 8, wherein the tungsten oxide is tungsten dioxide.

10. An impregnated cathode according to claim 8, wherein the thin film layer has a thickness of 50 to 1,000 nm.

11. An impregnated cathode according to claim 9, wherein the oxide of scandium in the thin film layer is in an amount of 2 to 30% on the basis of the weight of the thin film layer and a total of the oxide of scandium and the tungsten dioxide is in an amount of less than 50% on the basis of the weight of the thin film layer.

12. An impregnated cathode according to claim 1, wherein said thin film layer is a layer formed by sputtering or chemical vapor deposition.

13. An impregnated cathode according to claim 1, wherein the thin film layer is a coating layer formed on the surface of the impregnated cathode after impregnation of the electron emissive material in the refractory porous body.

14. An impregnated cathode according to claim 1, wherein the amount of said at least one member in the thin film layer is 1–30% by weight, and 1–50% by weight of the total tungsten of the thin film layer is in the form of said at least one oxide.

15. An impregnated cathode according to claim 1, wherein the refractory porous body has incorporated therein an activator selected from the group consisting of Zr, Hf, Ti, Cr, Mn, Si and Al.

* * * * *